United States Patent [19]

Tisler

[11] 3,950,756

[45] Apr. 13, 1976

[54] TUNABLE ANTENNA HAVING ADJUSTABLE LOOP CONFIGURATIONS

[76] Inventor: Marshall Stebbins Tisler, 826 Best St., Marseilles, Ill. 61341

[22] Filed: Apr. 28, 1975

[21] Appl. No.: 572,558

[52] U.S. Cl. ..... 343/766; 343/868; 343/877; 343/882

[51] Int. Cl.[2] ..... H01Q 7/02

[58] Field of Search ..... 343/723, 766, 868, 881, 343/882, 883, 877

[56] References Cited

UNITED STATES PATENTS 918,255 4/1909 Athearn ..... 343/880

2,702,345 2/1955 Walter ..... 343/723

*Primary Examiner*—Eli Lieberman

*Attorney, Agent, or Firm*—Ladas, Parry, Von Gehr, Goldsmith & Deschamps

[57] ABSTRACT

The antenna structure possesses a multi-sided configuration with means being provided for equally changing the lengths of at least two sides facing each other to thereby adjustably vary the physical size of the antenna. A parasitic reflector having a similar configuration and means for adjustability is positioned a predetermined distance behind the antenna proper for increasing the gain of the antenna structure.

16 Claims, 12 Drawing Figures

TRANSMITTER FREQ. 14.2 MHz S.W.R. 1:1
ANTENNA FREQ. 14.2 MHz
ALL READINGS ARE S METER
TAKEN AT 6 MILES WITH TS900
ON TUNER POSITION AT 15°
INCREMENTS

TUNABLE ANTENNA HAVING ADJUSTABLE LOOP CONFIGURATIONS

BACKGROUND OF THE INVENTION

It is generally known that an antenna which is resonant with the frequency of the received signal is purely resistive and if it is properly connected by a feedline to a transmitter-receiver apparatus, no standing waves will occur on the feedline.

Peak performance of a multi-element parasitic antenna array depends upon proper phasing or tuning of the elements which can be optimally effective for a single frequency only. In the case of closely spaced arrays, which because of the low radiation resistance are usually quite sharply tuning, the frequency range over which optimum results can be obtained is in the order of only one or two percent of the assigned (resonant) frequency. In order to operate over a wide frequency range, the antenna is generally de-tuned thereby sacrificing some gain over the entire frequency spectrum.

The forward gain, along with the rejection of unwanted signals off the sides (front-to-side ratio) and the rejection of un-wanted signals off the back (front-to-back ratio) are highest when the antenna is operating at a resonant frequency. This holds equally for the antenna whether it is receiving or transmitting. If the frequency deviates from this resonant frequency point, the forward gain as well as the ability to reject unwanted signals from the side or back rapidly deteriorates. When the antenna operates at its designated frequency point, un-wanted parasitic or harmonic signals are substantially attenuated.

Antenna structures with movable supports to change the physical as well as the electrical constants have been previously described. One such antenna structure is disclosed in U.S. Pat. No. 3,453,630 which operates in the UHF/VHF frequency range. In this known antenna structure, the physical size of the antenna is varied by means of pulleys together with a supporting structure. The supporting structure, however, is quite complex and the disclosure can be practical only in the range for which it was designed, i.e., in the high frequency range where the physical elements of the antenna structure are quite small, as compared with structure used in the low frequency ranges, for example, in the 10, 15 and 20 meter bands. For example, an antenna which is one wave length and adapted to transmit on 20 MHz would be 15 meters (47 feet) long, whereas an antenna operating at full wave length in the UHF frequency range, 300 MHz, would be 1 meter long (3.2 feet) long. Hence, the solution for the adjustment of an antenna operating in the UHF frequency range cannot be adopted readily for use in the lower frequency ranges because of insurmountable physical problems in constructing the antenna arrangements.

SUMMARY OF THE INVENTION

It is therefore an object of this invention to provide an antenna which can be readily tuned with a minimum of supporting structure.

Another object of this invention is to provide an antenna assembly having a minimum of structural elements adapted both for supporting and tuning an antenna to a predetermined frequency.

Another object of this invention is to provide a multi-sided antenna, the sides being made of flexible conductors which can be adjusted at one corner of the antenna.

Another object of this invention is an antenna assembly including a multi-sided antenna, the physical configuration of which can be adjusted with a motor remotely controlled from a transmitting station.

A further object of the invention is to provide an antenna assembly comprising a driven element and one or more parasitic elements for improving the gain, the antenna and the parasitic elements being simultaneously tunable.

An arrangement is provided for tuning a driven element to a predetermined resonant frequency, wherein each element is constructed of a plurality of members providing a multi-sided configuration, two generally opposing sides of the configuration capable of being adjusted in length. To increase the gain of the antenna, a parasitic element, having approximately the same configuration as the driven element, is positioned adjacent the driven element and is similarly adjusted to re-radiate the transmitted energy at the predetermined resonant frequency.

DESCRIPTION OF THE DRAWINGS

The invention will now be described in reference to the accompanying drawings, wherein.

DESCRIPTION OF THE PREFERRED EMBODIMENTS

Figure 1:
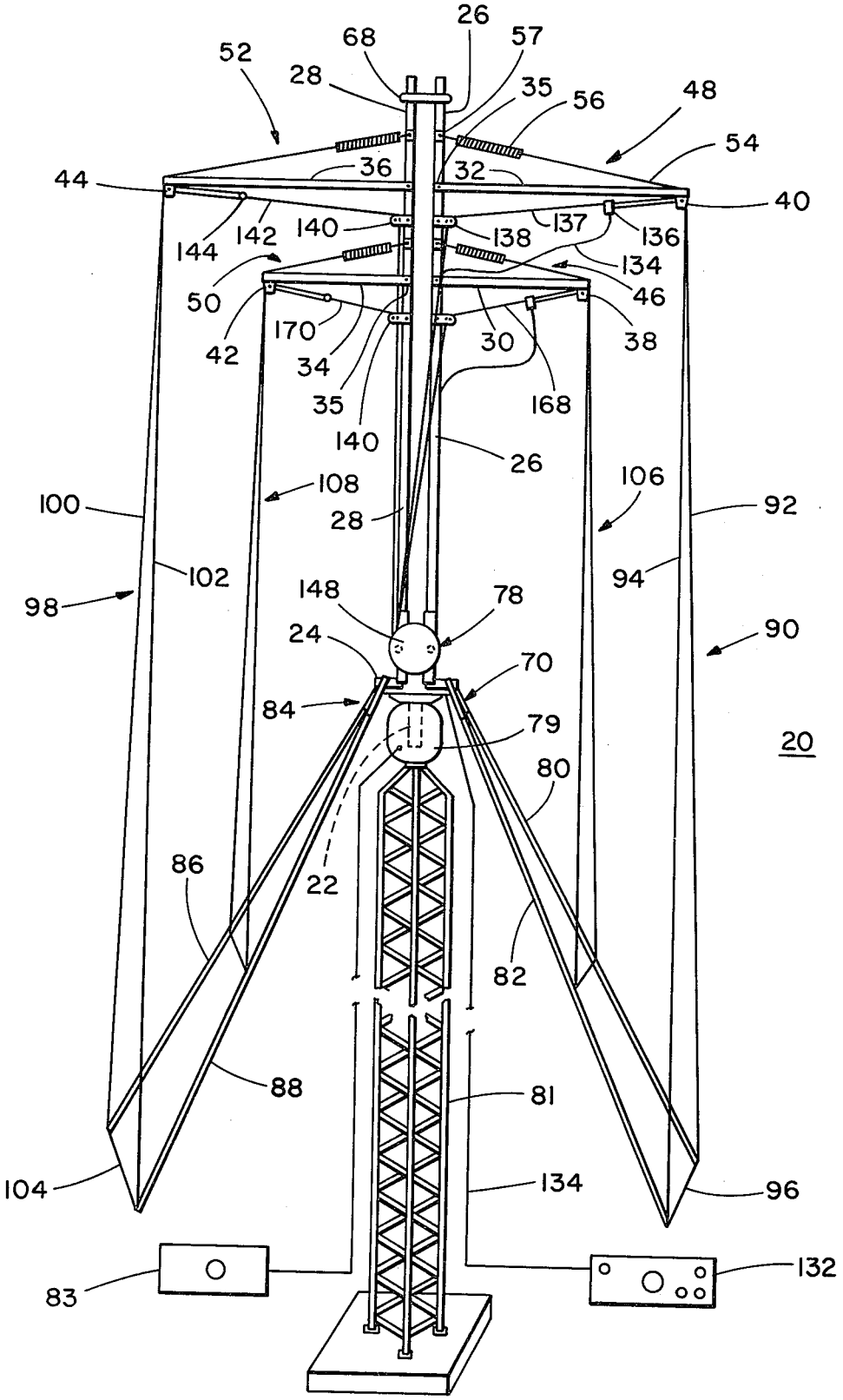
FIG. 1 is a side elevation of an antenna assembly mounted on top of a tower.
Figure 2:
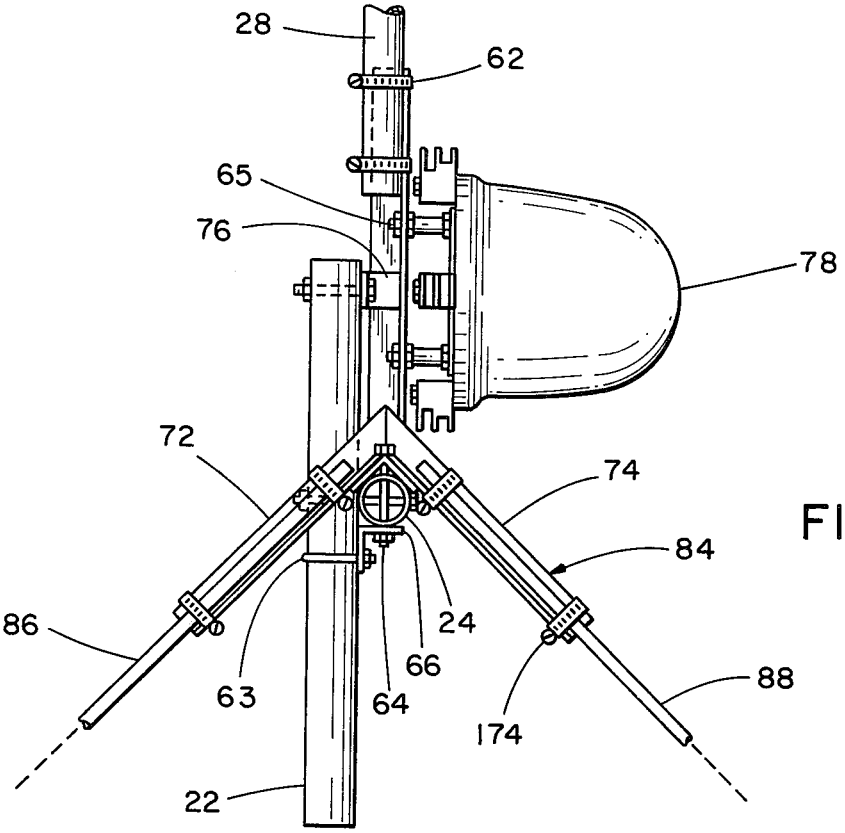
FIG. 2 is a fragmentary detail of a part of the antenna assembly shown in FIG. 1, showing the supports for spreader elements and masts.
Figure 3:
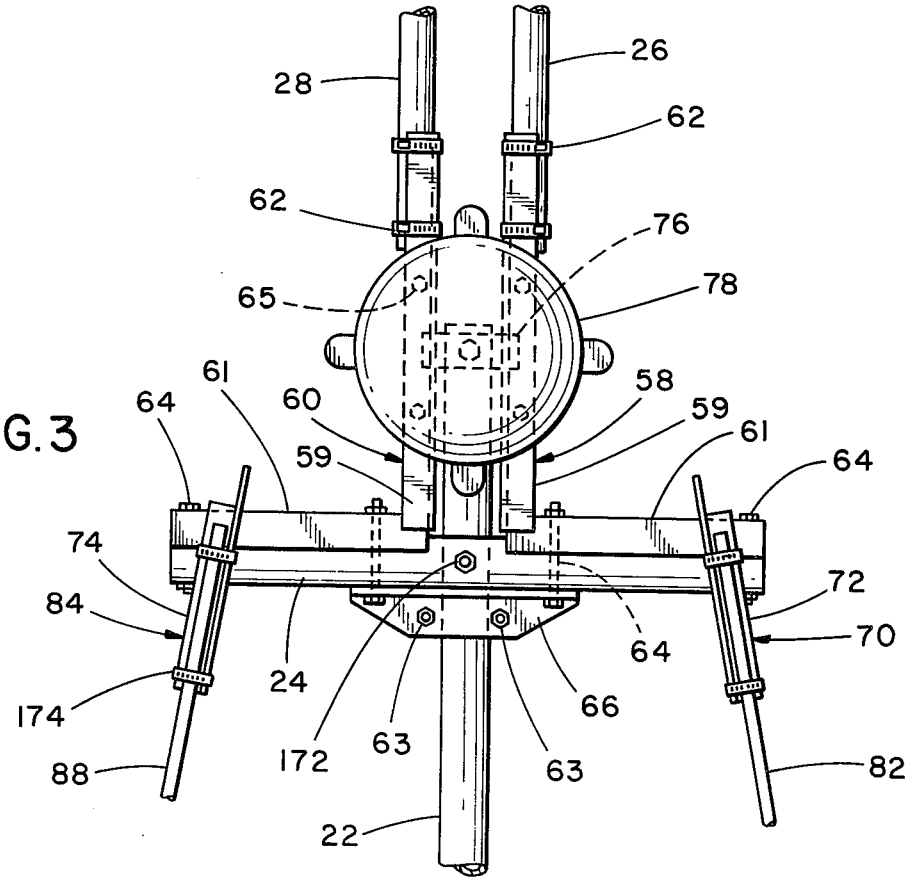
FIG. 3 is a front elevation view of the construction shown in FIG. 2.

Referring to FIGS. 1–3, an antenna assembly 20 comprises a rotatable member such as a stub mast 22 supporting a boom 24 which supports mast means which include a pair of masts 26 and 28. The mast 26 has a pair of outwardly extending yieldably movable arms 30 and 32 and, similarly, the mast 28 has also a pair of extending and yieldably movable arms 34 and 36, the arms functioning as support members, as will be described later. The free ends of the arms 30 and 32 are provided with pulley assemblies 38 and 40, respectively. The free ends of the arms 34 and 36 support shorting bar assemblies 42 and 44, respectively.

The other ends of the arms 30, 32, 34 and 36 are pivotally attached by pivots 35 to their respective masts 26 and 28 so that the free ends of the arms can be pivoted upwardly or downwardly.

The free ends of the arms 30 and 32 are resiliently supported by outriggers 46 and 48 which are attached to the mast 26, a short distance above the associated pivots 35.

Similarly, the free ends of the arms 34 and 36 are resiliently supported by outriggers 50 and 52, respectively, which are attached to the mast 28 a short distance above the associated pivots 35. The masts 26 and 28 and the arms supported thereon are preferably made from non-conducting material such as wood or resin.

Each outrigger, for example, outrigger 48 is provided with a cable section 54 attached to the free end of the arm 32, the other end being connected to a spring 56 which is adjustably secured with a clamp 57 to the mast 26. The spring 56 is a heavy duty one and has a 1-inch diameter and is about 1 foot in length. Each spring functions to apply tension to the free end of the respective arm to deflect it upwardly whenever a downward tension is reduced through the respective pulley assembly, such as 40. The clamp 57 can be slid vertically along the mast 26 and the cable section 54 may be adjusted in length to provide an adjustment of length of the outrigger 48. The cable section 54 may comprise a chain. A length of a chain (not shown) may be inserted inside the spring 56 to limit the amount of elongation (downward travel), thereby preventing a heavy load of ice from forcing the arm 32 below its lowest point of downward travel or deflection.

As shown in FIG. 3, the masts 26 and 28 are clamped to mast support brackets 58 and 60, respectively by means of stainless steel clamps 62. Each mast support bracket has an L-shaped construction having a leg 59 and a foot 61 which is fastened by bolts 64 to the boom 24 secured to a boom support bracket 66 attached by a U-bolt 63 to the mast 22. The upper ends of the masts 26 and 28 are secured to each other with a yoke 68. The leg and the foot may be integrally formed or can be secured to each other by means, such as welding. The free end of the foot 61 of the support bracket 58 has permanently secured thereto a spreader member 70 which has a pair of arms 72 and 74 defining an angle of 90 degrees therebetween. The mast support brackets 58 and 60 are coupled together with an anchor bracket 76, a motor 78, the function of which will be described later, is mounted on the mast support brackets 58 and 60 by means of bolts 65. The lower end of the stub mast 22 is adapted to couplingly engage a motor 79 mounted on top of a tower 81, the motor 79 functioning to rotate the antenna assembly 20 for beaming transmission in a predetermined azimuthal direction, the motor being controlled by a control 83.

The spreader member 70 supports a pair of spreader elements 80 and 82. Similarly, a spreading member 84 (FIG. 1) including arms 72 and 74 support a pair of spreader elements 86 and 88. The spreader elements function as support members, to be described later.

For transmitting on a 20 meter band a driven element or an antenna 90 has preferably a delta or triangular configuration which comprises flexible conductor elements 92, 94 and 96, wherein the conductor elements 92 and 94 extend from the free ends of the spreader elements 80 and 82, respectively, and angularly converge toward the pulley assembly 40. The conductor element 96 extends between the two free ends of the spreader elements 80 and 82 and defines a base for the delta configuration.

For transmitting on a 15 meter band, a driven element or an antenna 106 and its respective parasitic element or reflector 108 is positioned intermediate the antenna 90 and reflector 98 and the masts 26 and 28, as shown in FIG. 1. Although the embodiment shown in FIG. 1 shows an arrangement for transmitting only on 15 and 20 meter bands, it is clear that further driven elements and respective reflectors may be supported by supplying additional arms, such as arms 30 and 34. For example, if it is desired to transmit on a 10 meter band, an additional driven element and its respective parasitic element or reflector would be positioned between the antenna 106 and the reflector 108 and the masts 26 and 28.

Figure 4:
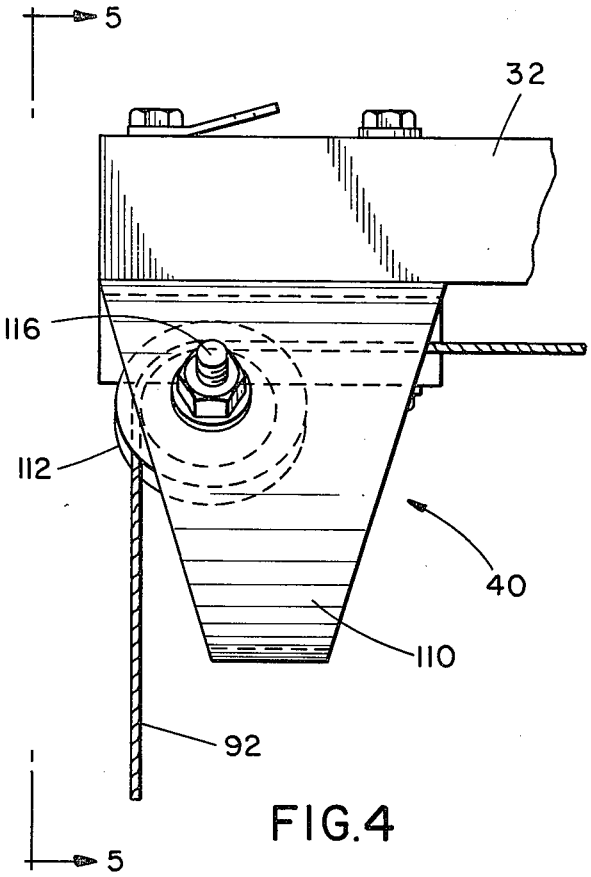
FIG. 4 is an enlarged fragmentary detail of a part of the antenna assembly in FIG. 1, showing the construction of a pulley assembly for adjusting the size of a driven element of the antenna assembly.
Figure 5:
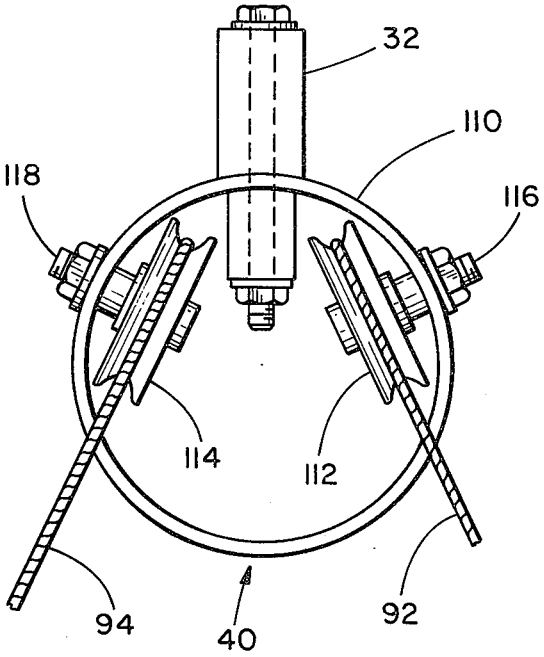
FIG. 5 is an end elevation view of the construction shown in FIG. 4.

Reference is now made to FIGS. 4 and 5 which show the details of the construction of the pulley assembly 40 which comprises a housing 110 made from a 3 inch, inside diameter, plastic tube, which forms a weather shield against icing. The housing 110 is secured to the free end of the arm 32. Inside the housing 110, there is a pair of pulleys 112 and 114, made from non-conductive material such as wood or resin, and rotatably supported on respective axles 116 and 118 and providing guidance for the flexible conductor elements 92 and 94 of the antenna 90. The conductor elements 92 and 94 are insulatingly supported in such manner that no shorting occurs therebetween inside the housing 110.

Figure 6:
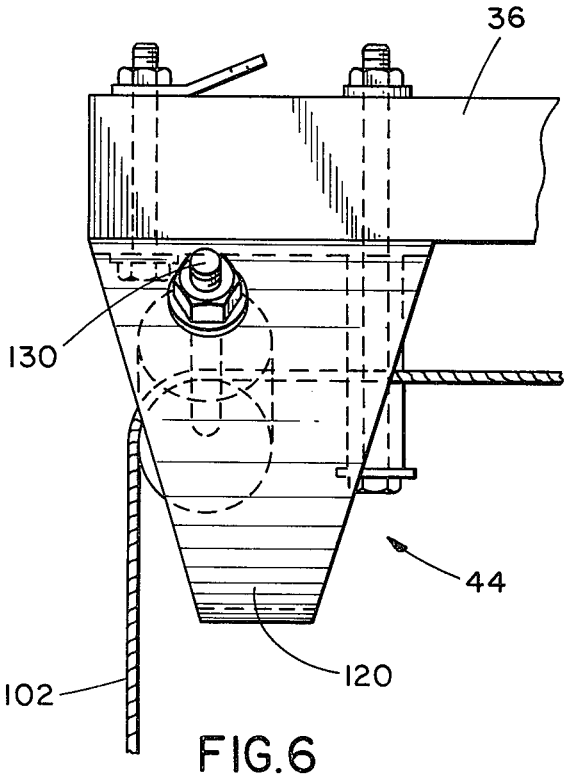
FIG. 6 is an enlarged fragmentary detail of a part of the antenna assembly in FIG. 1, showing the construction of a shorting bar assembly for adjusting the size of a parasitic element.
Figure 7:
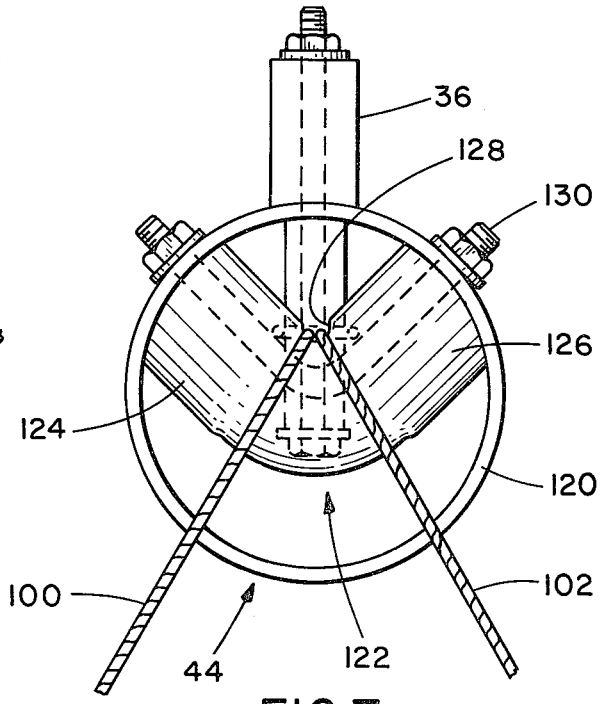
FIG. 7 is an end elevation view of the construction shown in FIG. 6.

The flexible conductor elements 110 and 102 of the reflecor 98 converge towards each other and meet in the shorting bar assembly 44, the details of the construction being shown in FIGS. 6 and 7. The shorting bar assembly 44 comprises a housing 120 constructed from a 3 inch, inside diameter, plastic tube which acts as a weather shield. Inside the housing 120, there is a shorting bar 122 made from a 1-inch diameter copper tube having a pair of arms 124 and 126 which define therebetween an angle of approximately 90°. On the inside of the angle defined by the two arms, there is a groove 128 which forms a channel for admitting the flexible conductor elements 100 and 102. The shorting bar 122 is supported within the housing 120 by an angle bolt 130. The housing 120 is secured to the free end of the arm 36.

The two antennas 90 and 106 are connected by a pair of coaxial cables to a transceiver 132. For example, antenna 90 is connected to the transceiver 132 by a cable 134 through a coupling device such as a balun 136 which is a well known device for connecting a feed line to an antenna for reducing coaxial line radiation and reducing coaxial line pickup. The balun 136 is in turn connected to the free ends of the flexible conductor elements 92 and 94 passing over the pulleys 112 and 114, respectively, as shown in FIG. 5. The balun 136 is provided with an eyelet (not shown) to which is attached a nylon cord 137 which passes through a pulley assembly 138 in a downwardly direction toward the motor 78, as shown in FIG. 1. The motor 78 may be a common antenna rotator which has been converted to serve as a power source to apply tension to the nylon card 137 connected to the balun 136 or to a nylon cord 142 attached to a ring 144 connected to the converging ends of the flexible conductors 100 and 102 passing through the shorting bar assembly 44, as shown in FIG. 7.

Figure 8:
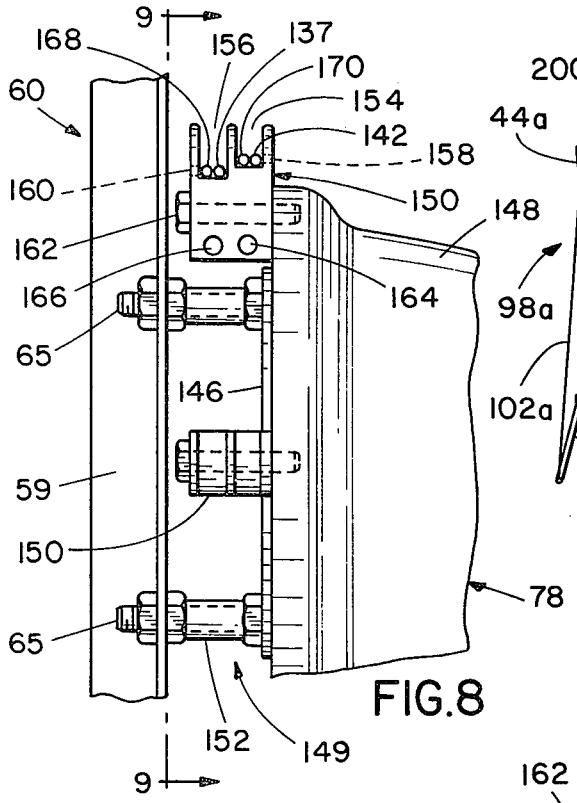
FIG. 8 is a partial section of a side view of a reel mounted on a motor and used for adjusting the size of the driven and parasitic elements.
Figure 9:
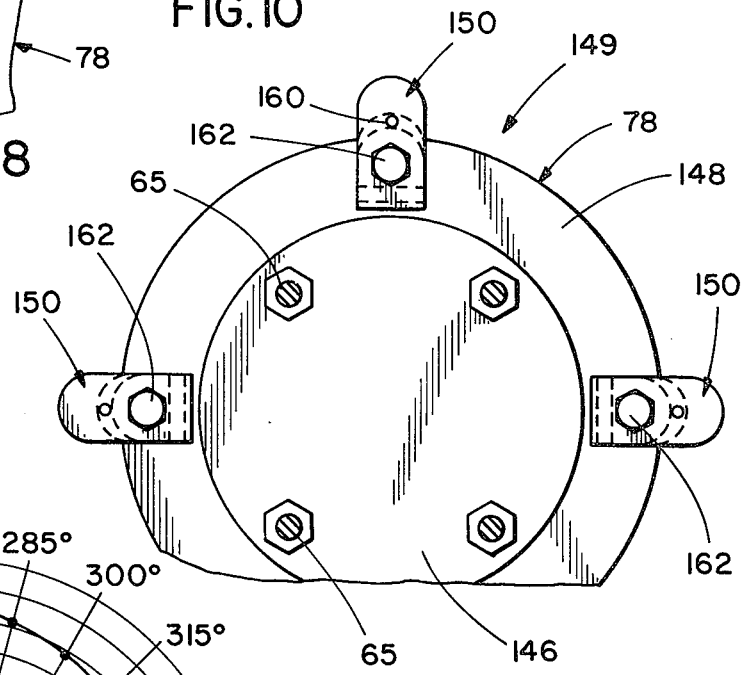
FIG. 9 is a partial section along lines 9 - 9 of the reel and the motor shown in FIG. 8.

The motor 78 comprises a stator 146 and a rotor 148, the stator being mounted by means of bolts 65 on the mast support brackets 58 and 60. An enlarged view of the mounting is shown in FIG. 8. A plurality of channeled lugs 150 are circumferentially mounted on the rotor 148. As viewed in FIG. 9, the lugs 150 and the rotor 148 cooperatively combine to form a reel 149. As shown, there are four lugs 150, however, it is clear that more lugs can be distributed around the periphery of the rotor 148 or, in the alternative, a reel, per se, can be mounted on the rotor 148. As shown in FIG. 8, spacers 152 on the bolts 65 position the motor 78 away from the leg 59 a sufficient distance to provide freedom for the rotation of the reel.

Each lug 150 has a pair of channels 154 and 156, the channel 156 being deeper than the channel 154. The channels 154 and 156 are provided with transverse openings 158 and 160, respectively. Each lug 150 is mounted by means of a bolt 162 to the rotor 148 and is provided with a pair of openings 164 and 166 which are centrally disposed under the respective channels 154 and 156. The lugs 150 may be formed from any material and, in the present case, are made from aluminum. The cord 137 coupled to the antenna 90 is admitted into the channel 156 and the cord 142 associated with the reflector 98 is admitted into the channel 154. Another cord 168 coupled to the antenna 106 is admitted into the channel 156 and another cord 170 associated with the reflector 108 is admitted into the channel 154. The reel 149 is capable of admitting cords from a pair of antennas and associated reflectors. However, if the channels 154 and 156 are made wider, additional cords, connected to further antennas and associated reflectors, can be admitted into the channels. When the motor 78 is energized, the reel will rotate, for example in a counter-clockwise direction, as viewed in FIG. 1, to increase the tension already applied to the cords 137, 142, 168 and 170. As the tension is increased, the respective arms 30, 32, 34 and 36 will be deflected downwardly, thereby shortening the lengths of the supported flexible conductor elements of the antennas 96 and 106 and the respective reflectors 98 and 108. The shortening of the flexible conductor elements, for example, 92 and 94 will decrease the size of the delta antenna 90 making it more effective for transmitting at a higher frequency. If the antenna 92 is to be tuned to a lower frequency, the motor 78 is energized so that the rotator 148 rotates in a clockwise direction (FIG. 1), thereby decreasing the tension on the cord 137, thus allowing the outrigger 48 to deflect the arm 32 in an upwardly direction. This results in the lengthening of the flexible conductor elements 92 and 94, thereby providing a larger delta configuration.

The reason why the channels 154 and 156 have different depths is that the flexible conductor elements forming the parasitic reflector, for example the reflector 98, are somewhat longer than the flexible conductor elements forming the driven element or antenna proper 90. The depths of the channels 154 and 156 have been accentuated to show the difference in the two diameters, however, the actual difference is slight.

The method of securing one of the cords, for example cord 168 to one of the lugs 150 is accomplished by feeding the free end of the cord through the hole 166 (FIG. 8) and then bringing it upwardly and passing it through the hole 160. Then the end may be knotted or passed under the portion of the cord coming out of the hole 166. The free end of the cord 168 is fastened to the lug 150 with just sufficient tension so that the associated arm 30 is slanted upwardly by the tension applied by the spring 56 in the outrigger 46.

The length of each side of the delta antenna 90 is one third of a wave length. The two vertically extending flexible conductor elements 92 and 94 change in length as the antenna is tuned from one end of the transmitting band to the other, i.e., from 14.0 MHz to 14.3 MHz on the 20 meter band. A total change of about 20 inches or 10 inches in each of the flexible conductor elements 92 and 94, occurs. When the antenna 106 is tuned for transmission on the 15 meter band, a total change of about one foot occurs when tuning from 21.0 MHz to 21.45 MHz.

Since the presence of any metal in the plane of the antenna has a deleterious effect on performances, the spreader elements 80, 82, 86 and 88 have been designed to deviate downwardly and outwardly, about 10 degrees from the vertical of the tower 81.

As discussed before, the balun 136 is used between the coaxial cable 134 and the parallel portions of the flexible conductor elements 92 and 94 extending beyond the pulley assembly 40, thereby providing a more efficient transfer of power from the unbalanced coaxial cable to a balanced feed line and antenna. This prevents feed line radiation that could deleteriously affect the radiation pattern of the antenna. The antenna 90 and its respective reflector 98 were first set up to transmit on the 20 meter band. Adjustments were made until it performed satisfactorily. Then, the antenna 106 and its respective reflector 108 were installed for operation on the 15 meter band. No change in the 20 meter band transmission could be detected. The radiation pattern remained the same. Then, the antenna 106 and its respective reflector 108 were tuned and put into operation and the antenna 106 was found to have the same performance as the antenna 90.

For carrying out the test on this antenna assembly, a Kenwood Model T S 900 transceiver was used. It is capable of putting out 180 watts of power P.E.P. into the antenna. Tests were made with the transmitter in a tuned position producing about 75 watts of power. Initially, the transmitter was tuned into a 50 watt dummy load. The antenna was then switched to the transmitter and then tuned until a SWR meter again read at the lowest SWR with forward power setting at 100%. Usually, the SWR meter shows about the same reading at resonance as the dummy load. This is the point where the antenna shows the best forward gain and back-to-front ratio.

Figure 12:
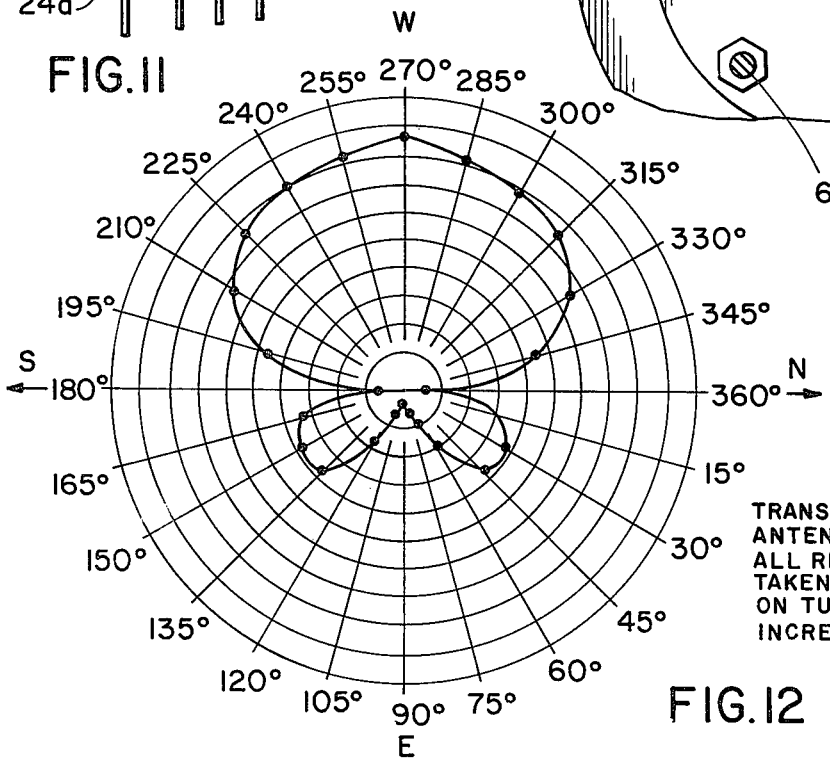
FIG. 12 is a radiation pattern of an antenna assembly transmitting at a resonant frequency.

A radiation pattern for a tuned antenna 106 (15 meter band) is shown in FIG. 12. The antenna was mounted on the tower 81 with the boom 24 at about 62 feet above ground. The vertically extending flexible conductor elements of the antenna 106 were tuned in relation to each other at the center of the band to the lowest SWR, then tuned to each end of the band. This was repeated several times before the antenna tuned from one end of the band to the other with a low SWR. With a little effort taken to tune the antenna, a SWR reading of 1:1 to 1.1:1 can be obtained at any point in the band. Referring to the radiation pattern in FIG. 12, the transceiver was tuned to a frequency of 14.2 MHz and the antenna was similarly tuned to 14.2 MHz. A SWR of 1:1 was obtained. All readings were taken with a S meter about 6 miles from the transmitter site at 15° increments.

To determine the effect of the antenna assembly when it was not tuned to the proper transmitter frequency, one test was performed where the transmitter frequency was 14.2 MHz and the antenna was de-tuned to a frequency of 14.1 MHz. It was found that the forward gain was decreased by one unit and there was a deterioration in the back-to-front ratio.

Similarly, another test was performed where the transmitter operated at a frequency of 14.2 MHz and the antenna was de-tuned to a frequency of 14.3 MHz. A similar loss of forward gain and increase of power radiated from the back of the antenna was determined.

As was previously described, the tuning of the driven element and its associated reflector is achieved by operating the motor 78, thereby causing the reel 149 to rotate and to increase or decrease tension applied to the attached cords. If the motor 78 is operated to substantially release most of the tension on the cords, the springs 56 associated with the arms 30, 32, 34 and 36 will cause the extending ends of the arms to move upwardly as the arms pivot about their respective pivots 35. On the other hand, as tension is increased on the cords, the arms will pivot downwardly. It will be noted that the pulley assemblies, such as 138 and 140 are supported on the masts 26 and 28, respectively, just a short distance below their respective arms 32 and 36 so that the horizontal vector of the force applied to the cords, such as cord 137, under the arm 32 is mostly counter-balanced by the arm itself, as the arm pivots from its initial upwardly slanting position to a downwardly slanting position.

The spreader elements 80 and 82 forming a part of the antennas 90 and 106 are rigid so that the respective flexible conductor elements such as 96, forming the base of the delta configuration, do not move.

As was described, the antenna 90 is made of flexible conductor elements 92, 94 and 96, such as wire, and is fed at the apex of the delta, with an arrangement provided for tuning the vertically extending sides of the delta by lengthening or shortening these sides by means of the motor 78 which is remotely controlled from the transceiver site. The motor 78 is mounted as low as possible in the antenna assembly just above the top of the tower 81, thereby providing a low center of gravity which contributes to stability of the antenna assembly when the tower is subjected to wind pressures. The motor 79, for rotating the antenna assembly 20 is mounted just below the antenna assembly. This type of construction places the bulk of the weight and wind resistance substantially below the antenna assembly making the antenna assembly more stable in high winds and under icing conditions.

One of the problems associated with the erection of an antenna assembly on top of a tower is the difficulty of elevating the antenna assembly to the top. In many cases, it was necessary to utilize a derrick. If the tower was pivotally supported at its base, it was necessary to mount the antenna assembly at the other end of the tower, while it was supported on the ground and then means had to be employed to erect the tower and its mounted antenna assembly into a vertical position. The foregoing difficulties have been substantially overcome with the construction of the antenna assembly described herein. The described antenna assembly actually comprises two sub-assemblies, a driven element sub-assembly and a corresponding reflector element sub-assembly. The following description will show how the two sub-assemblies are mounted on the tower 81.

The erection of the two sub-assemblies is initiated by first securing the boom support bracket 66 to the stub shaft 22 by means of the U-bolt 63 and then securing the boom 24 to the stub shaft 22 with a bolt 172. Thereafter, the stub shaft 22 is placed on top of the tower 81 in such a manner as to be drivingly engaged with the motor 79. The next step is concerned with the erection of the sub-assemblies. Since both sub-assemblies are erected in the same manner, only the erection of the reflector element sub-assembly will be described.

On the ground, the mast 28 is fastened to the mast support bracket 60 with clamps 62. Thereafter, referring to FIG. 1, pulley assemblies 140 and arms 34 and 36, as well as outriggers 50 and 52 are attached to the mast 28. Spreader elements 86 and 88 are secured to the arms 72 and 74 of the spreader member 84 with clamps 174. The flexible conductor elements, such as 100, 102 and 104 are secured to the spreader elements 86 and 88, respectively, and then the flexible conductor elements 100 and 102 are passed through the shorting bar assembly 44 and attached to the cord 142. Similar procedure is followed in erecting the reflector 108. Thereafter, the foregoing sub-assembly which weighs about 35 pounds is taken and placed on top of the boom 24 and fastened thereto with bolts 64.

The driven element sub-assembly is similarly erected and placed on top of the tower 81. Thereafter, the motor 78 is secured to the mast support brackets 58 and 60 with bolts 65, as previously described. The upper ends of the masts 26 and 28 are secured together with the yoke 68. The mast support brackets 58 and 60 are secured together with a bracket 76. Thereafter, the free ends of the cords are attached to the lugs 150 mounted on the rotor 148.

Regarding the construction details of the various components of the antenna assembly, the dimensions of the various components given herein are entirely exemplary.

The diameter of the reel as defined by the channeled lugs 150 is about 8 inches. Thus, one revolution of the reel makes a change of approximately 24 inches to each side of the flexible conductor elements such as 92 and 94, making a total change of 48 inches. This is more than necessary to tune the 20 meter band antenna 90 which requires a greater change in length for the flexible conductors than that employed in the 15 meter band antenna 106.

The masts 26 and 28 are made from 1 inch diameter aluminum tubing. The stub shaft 22 and the boom 24 are 1¼ inch diameter steel or aluminum tubing. The legs 59 of the two brackets 58 and 60 are made from 1-inch angle iron and the feet 61 are made from 1¼ inch angle iron, and welded together to give the necessary strength to support the two spreader members 70 and 84 spaced apart and slanted outwardly at an angle of 10° from the vertical, as previously described.

The lengths of the spreader elements used in the driven and reflector elements for the 20 meter band are different. The spreader elements 80, 82 associated with the driven side are 16 feet long and the spreader elements 86, 88 associated with the reflector side are 17 feet long. The reflector spreader element is approximately 3% longer than the driven spreader element to allow for proper re-radiation function. The reflector spreader elements, such as 86 and 88, can be made up of sections, the first section being seven feet and made from 1⅛ inch diameter aluminum tubing, then followed by a hard wood insulator connected to a 1 inch diameter aluminum tubing having a total section of 10 feet which is broken up into four equal shorter pieces interconnected by hardwood insulators. In the alternative, the spreader elements may be rods made from reinforced resin.

The length of the base of the delta antenna, as represented by the driven flexible conductor element 96, is one third wave length or about 22 feet and 6 inches and about 23 feet and 6 inches for the corresponding reflector flexible conductor element 104, for the 20 meter band. On the 15 meter band, the length of the driven element which represents the base of the delta antenna 106 is about 13 feet 6 inches and about 14 feet for the reflector element. The arms, such as 32, may be made of two members telescoped together so that a degree of adjustability can be obtained. For the antenna 90, the arm 32 is about 4 feet long.

In each of the described 15 and 20 meter band antenna assemblies, only a single parasitic reflector element was used. However, it is possible to add further parasitic elements in front or back of the driven antenna to obtain additional gain.

To further increase the gain of one of the antenna assemblies shown in FIG. 1, additional parasitic elements may be added without requiring an extensive modification. As previously described, the arrangement for transmitting on the 20 meter band comprises the antenna 90 and its associated reflector 98. If it is desired to improve the gain characteristics of this 20 meter band arrangement, the boom 24, which is relatively short, can be replaced by an elongated boom about 16 feet in length with the spreader members 70 and 84 including associated spreader elements 80, 82, 86 and 88 being mounted adjacent the motor 78 in the same manner as shown in FIG. 1.

At each end of the elongated boom, there would be mounted an additional mast support bracket, such as 60 which, as shown in FIG. 3, includes the foot 61 supporting the spreader member 84 and the associated spreader elements 86 and 88, as well as including the leg 59 to which is secured the mast 28 supporting the arm 36.

Such addition of a spreader member and associated spreader elements to the left of the reflector 98, as shown in FIG. 1, would provide support for a further delta reflector which would have a size slightly greater than the delta reflector 98.

Similarly, at the other end of the elongated boom, there would be mounted another mast support bracket and associated spreader member and its associated spreader elements together with a mast and associated arm which would cooperate to support a delta configuration of an antenna which would function as a director. The size of the delta director would be somewhat smaller than that of the driven delta antenna 90. As a result, the driven antenna 90 would have behind it a pair of reflectors, the reflector 98 and the additional reflector supported at the end of the elongated boom, as just described, and a single director spaced in front of the antenna 90 and supported at the other end of the elongated boom, as described above.

The foregoing described modification could be made with the two antenna embodiment shown in FIG. 1, wherein the 15 meter band arrangement, which includes the driven antenna 106 and its associated reflector 108, would remain in place. In the alternative, if transmission is desired only on a single frequency, namely the 20 meter band, the 15 meter band arrangement comprising the driven antenna 106 and its associated reflector 108 would not be installed.

The tuning of the additional reflector and director would be accomplished with the same motor 78 rotating the reel 149 which would be provided with an additional channel for accepting the nylon cords attached to the vertically extending flexible conductor elements comprising the additional reflector and the director.

In using an antenna arrangement having more than one parasitic element, the elongated boom could be provided with a series of spaced apertures, vertically disposed, which would be used for mounting the mast support bracket, such as 60, and spreader member, such as 70, anywhere along the length of the boom so that spaced adjustments between the driven and the parasitic elements can be readily achieved. In the alternative, it is possible that the elongated boom may slidably support the mast support bracket, such as 60, wherein the bracket would be provided with a securement which would permit it to be clamped anywhere along the length of the elongated boom.

Figure 10:
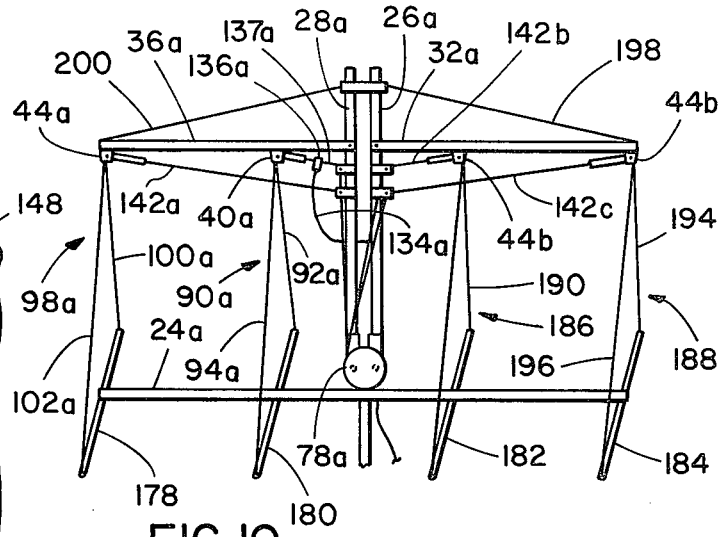
FIG. 10 is a perspective view of another embodiment of the antenna assembly showing only the bare essentials indicating the disposition of a driven element in relation to a reflector and a pair of directors.
Figure 11:
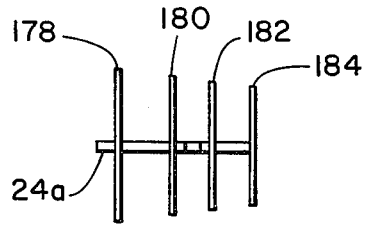
FIG. 11 is a simplified plan view, reduced in size, of the antenna assembly shown in FIG. 10.

With some modification, the antenna assembly shown in FIG. 1 may be used for transmitting at a higher frequency, for example, on a 6 meter band, using a plurality of parasitic elements. The wave length at this frequency is about 16.5 feet and one-third of the wave length would be about 5.5 feet. Therefore, each side of the delta antenna would be about 5.5 feet long. In view of the shorter wave length, the spreader arrangement, for example, comprising spreader members 70 and 84 and the associated spreader elements 80, 82, 86 and 88 can be dispensed with and at the same time a longer boom 24 can be used for directly supporting the base of the delta antenna. This modification can be readily understood by reference to FIGS. 10 and 11, wherein an elongated boom 24a is used to insulatingly support a plurality of members 178, 180, 182 and 184, the members being spaced on both sides of masts **26*a* and 28*a*,** as shown. Each of the members comprises a resilient bar which functions as the base for the delta antenna. On the other hand, the members may be made of reinforced resin material and have a construction wherein tapering occurs from the midpoint of each member towards both ends so that the ends can be flexed more readily.

Since the arrangement for supporting a plurality of antenna sub-assemblies is the same as that described in reference to the first embodiment, the similar supporting structure will be identified by identical reference numerals suffixed by an alphabetical designation. The supporting structure for the apex of the delta configuration is essentially the same as that disclosed in FIG. 1, except that the arms are stationary rather than yieldably movable (pivotable).

The member 178 defines the base of the delta reflector antenna **90*a*, which also has a pair of flexible conductor elements 100*a* and 102*a* extending vertically and converging to an apex for support at the end of an arm 36*a*, the apex of the configuration being supported by a shorting bar assembly 44*a*. The member 180 forms a base for a delta driven antenna 90*a*, the ends of the member 180 being attached to a pair of vertically extending flexible conductor elements 92*a* and 94*a* which converge toward an apex which is supported by a pulley assembly 40a secured to the arm 36*a***.

The upper ends of the flexible conductor elements 92*a* and 94*a* pass through the pulley assembly 40*a* and are connected to a bulun 136*a* which is coupled through a nylon cord 137*a* to a motor 78*a*. The balun 136*a* is connected to a cable 134*a*.

For achieving further improvements in the gain of the transmission, director sub-assemblies are spaced in front of the driven antenna 90*a*. A pair of directors 186 and 188 are essentially constructed and supported in the same manner as the reflextor antenna 98*a*. For example, the director 186 has a base of the delta configuration formed by the member 182 which provides securement for a pair of vertically extending flexible conductor elements 190 and 192 which converge together and are supported by a shorting bar assembly 44*b* which is identical to the shorting bar assembly 44 illustrated in FIGS. 6 and 7. Similarly, the director 188 has a delta configuration wherein the base is formed by the element 184 having attached at its ends a pair of upwardly converging flexible conductor elements 194 and 196 supported by a shorting bar assembly 44*a*. The converging ends of the flexible conductor elements comprising the directors 186 and 188 are connected by nylon cords 142*b* and 142*c* to the motor 78*a*.

The manner of tuning or adjusting this modified antenna assembly consists of operating the motor 78*a* to increase or decrease tension applied to the flexible conductor elements by means of nylon cords 137*a*, 142*a*, 142*b* and 142*c*. As previously indicated, the arms 36*a* and 32*a* are immovably supported on the masts 26*a* and 28*a*. To ensure that the arms 32*a* and 36*a* will not pivot or bend during the tuning operation, the arms are supported, at their ends, by guy members 198 and 200 attached to the tops of the mast members 26*a* and 28*a*. As tension is increased at the apexes of the driven antenna 90*a* and parasitic antennas 98*a*, 186 and 188, the flexible elements 178, 180, 182 and 184 associated with the foregoing antennas will assume a more pronounced arcuate shape, wherein the ends of the elements 178, 180, 182 and 184 will curve upwardly, thereby shortening the lengths of the upwardly extending flexible conductor elements. If the member, such as 178, is a tube, the arcuate deformation will be uniform throughout the length of the member. On the other hand, if the member 178 is a bar made of reinforced resin material having a tapered construction, the arcuate deformation will not be uniform, however, this is of no consequence, the primary objective being to obtain shortening of the flexible conductor elements to achieve tuning.

The spatial disposition of the parasitic elements 98*a*, 186 and 188 with respect to the driven element 90*a* is such as to follow the established norms for achieving maximum gain. The resilient elements 178, 180, 182 and 184 are made preferably from a conductive material and are insulatingly mounted on the boom 24*a*.

As is conventional, the size of the reflector antenna 98*a* is larger and the size of the directors 186 and 188 are smaller than the driven element 90*a*. Also, each additional reflector, that may be added, would be larger than the immediately preceding reflector and, similarly, each additional director that is used would be smaller than the immediately preceding director. The members 178, 180, 182 and 184 may be made from metallic or non-metallic rods or tubes. If tubes are employed, a continuous length of a flexible conductor element such as a wire cable, is passed through the tube and then both ends are brought upwardly and convergingly towards the apex of the delta antenna to be supported by an associated pulley assembly or shorting bar assembly. If non-metallic rods are used, these would have to be coated with a metallic film and conductively connected to the pair of the upwardly vertically extending conductor elements such as 190 and 192. If metallic rods are used, then the two vertically extending conductor elements would be connected to the ends of the rods. It is preferable to use the tubes for the reason that a single wire cable can be used to form the three sides of the delta configuration.

Although the various structures described herein have been indicated as having been made from particular materials, it should be apparent that other materials may be used or a combination of materials and structure assemblies can be utilized to improve the gain of the described antenna assemblies. For example, masts 26 and 28 can possess a construction similar to that indicated for one form of the spreader elements 80, 82, 86 and 88. Specifically, the masts 26 and 28 can be constructed of short sections of metallic tubes intercoupled together by insulator members.

As can be seen, a simplified arrangement has been provided for tuning an antenna driven element and its associated parasitic reflector without requiring the use of complex support structure. Variations and modifications of this invention may be effected without departing from the spirit and scope of the novel concept disclosed and claimed herein.

I claim:

1. An antenna assembly comprising an element, a plurality of support points for supporting said element, at least one of said support points being yieldably movable, and means for controlling the physical dimensions of said element to achieve tuning of said element to a predetermined frequency, said element comprising a plurality of flexible conductors defining a multi-sided configuration having a plurality of corners, each corner being supported by one of said support points, two of said flexible conductors having free ends converging toward each other and toward one of said corners to define a feedpoint passing through and beyond said corner, said control means being securable to said free ends to control tension applied thereto to vary the lengths of said flexible conductors between said support points.

2. The antenna assembly according to claim 1, wherein said configuration is a delta having a base defined by one of said flexible conductors extending across a pair of said support points and an apex defined by said flexible conductors having said free ends and extending from said pair of support points to a corner associated with said yieldably movable support point.

3. The antenna assembly according to claim 2, including mast means, said pair of support points being defined by a pair of substantially elongated support members having joined ends and defining an acute angle therebetween, said joined ends being secured to said mast means, said pair of support members extending downwardly and away from said mast means, said remaining support point being defined by a support member secured to said mast means above said pair of elongated support members and extending substantially normal to said mast means.

4. The antenna assembly according to claim 1, said free ends of said converging flexible conductors being connected to a coupling device connected to an input cable, said control means including a motor, a pulley and a cord, said cord being secured to said coupling device and extending through said pulley to said motor, whereby actuation of the motor increases or decreases the tension existing on said cord to vary the lengths of said converging flexible conductors.

5. The antenna assembly according to claim 3, wherein said mast means is mounted on a rotatable member coupled to a motor mounted on a tower, whereby said mast means supporting said delta configuration can be rotated to change its azimuthal direction.

6. The antenna assembly according to claim 3, including a pulley assembly supported at the free end of said remaining support member, said pulley assembly comprising a pair of spaced pulleys mounted within a housing, said pulleys being angularly mounted with respect to each other and having grooves aligning respectively with said flexible conductors having said free ends, whereby said pulleys are substantially protected from weather elements.

7. The antenna assembly according to claim 1, including a second element, a similar plurality of support points for supporting said second element a predetermined distance from the first element, at least one of said support points being yieldably movable, said second element functioning as a parasitic member, and second means coordinated with said first means for controlling the physical dimensions of said parasitic member, said parasitic member comprising a similar plurality of flexible parasitic conductors defining a parasitic multisided configuration having a similar plurality of corners, each corner being supported by one of said support points, two of said flexible parasitic conductors having free ends converging toward each other and nesting together at one of said corners and passing through one of said support points, said second control means being securable to said free ends to control the tension applied thereto to vary the lengths of said flexible parasitic conductors between said support points.

8. The antenna assembly according to claim 7, wherein said parasitic configuration is a delta having a base defined by one of said flexible parasitic conductors extending across a pair of said support points and an apex defined by said flexible parasitic conductors having said free ends and extending from said pair of support points to the remaining support point, the flexible parasitic conductors having a predetermined length relationship with respect to said flexible conductors comprising said first element.

9. The antenna assembly according to claim 8, including mast means, said pair of support points being defined by a pair of substantially elongated support members having joined ends and defining an acute angle therebetween, said joined ends being secured to said mast means, said pair of support members extending downwardly and away from said reflector mast means, said remaining support member being secured to said mast means above said pair of support members and extending substantially normal to said mast means.

10. The antenna assembly according to claim 9, wherein said mast means is mounted on a rotatable member.

11. The antenna assembly according to claim 9, including a shorting bar assembly supported at the free end of said remaining support member, said shorting bar assembly comprising a shorting bar mounted within a housing, said shorting bar having a pair of arms defining an interior angle and a groove therebetween, said free ends of said pair of flexible parasitic conductors slidably passing over said shorting bar through said groove unto said second means, said second means comprising a second cord connected to said free ends and extending through a pulley to said motor, whereby actuation of the motor controls the tension applied to said second cord to vary the lengths of said flexible reflector conductors.

12. The antenna assembly according to claim 11, including a reel rotatably mounted on said motor, said reel having a pair of spaced circular channels having different diameters, the cord connected to the free ends of the flexible conductors being admitted into the channel having the smaller diameter, and the cord applying tension to the free ends of said flexible parasitic conductors being admitted into said other channel.

13. The antenna assembly according to claim 1, wherein said configuration is a delta having a base defined by a resilient elongated member defining two of said support points, a pair of said flexible conductors extending from the ends of said elongated member and converging toward the apex immovably supported by one of said support points.

14. The antenna according to claim 13, including at least one more element having a similar delta configuration similarly supported, and spaced a predetermined distance from said first element to re-radiate energy transmitted by said first element.

15. An antenna assembly comprising at least a pair of driven antennas and at least one parasitic antenna associated with each of said driven antennas, a plurality of support points for supporting each antenna, at least one of said points being yieldable, and control means for simultaneously controlling the physical dimensions of all of said antennas for tuning said antennas for transmission at predetermined frequencies, each antenna comprising a plurality of flexible conductors defining a multi-sided configuration having a plurality of corners, each corner being supported by one of said support points, two of said flexible conductors having free ends converging toward each other and toward one of said support points and passing through said corner, said control means being securable to said free ends to control the tension applied thereto to vary the lengths of at least two of said flexible conductors.

16. The antenna assembly according to claim 15, wherein said control means comprises a motor, a reel arranged to be rotated by said motor, said reel having a plurality of channels having different diameters, and linkages connected between said reel and some of the corners of all of said antennas for regulating the tensions applied to said flexible conductors, at least one channel being associated with the driven antennas and the other channels being associated with the parasitic antennas.

* * * * *